United States Patent [19]

Bennett et al.

[11] Patent Number: 4,857,679

[45] Date of Patent: Aug. 15, 1989

[54] ALARM SYSTEM

[76] Inventors: Brian S. Bennett, 3 Milton Avenue, Barnet, Hertfordshire; David Smith, 31 Eastry Avenue, Hayes, Kent, both of England

[21] Appl. No.: 135,297

[22] Filed: Nov. 19, 1987

[30] Foreign Application Priority Data

Nov. 20, 1986 [GB] United Kingdom ..... 8627788
Jun. 4, 1987 [GB] United Kingdom ..... 8713115

[51] Int. Cl.[4] ..... H01H 3/16; H01H 9/02; G08B 25/00

[52] U.S. Cl. ..... 200/61.62; 200/300; 340/303

[58] Field of Search ..... 200/43.08, 43.18, 61.08, 200/61.76–61.8, 300; 340/303, 304, 590

[56] References Cited

U.S. PATENT DOCUMENTS 2,822,451 2/1958 Holmes ..... 200/300
3,143,611 8/1964 Nansel ..... 200/300 X
3,715,743 2/1973 Denton ..... 340/303

*Primary Examiner*—J. R. Scott

*Attorney, Agent, or Firm*—Wenderoth, Lind & Ponack

[57] ABSTRACT

An alarm switch has a box for mounting on a supporting surface, a front plate movably mounted in the box, a frangible element having a plurality of frangible areas spaced in succession thereon and each of which can be broken off the frangible elements, a stop element on either the box or the front plate, and the frangible element being on the remaining one of the box and the front plate, the stop element and the frangible element being positioned for, when the front plate is moved from a normal position relative to the box, the stop element and one of the frangible areas are engaged for causing the frangible area to be broken off the frangible element, and the frangible element and the stop element being shiftable relative to each other for, after one frangible area has been broken off, bringing the stop element and the next frangible area in succession into position for being engaged with each other when the front plate is moved again, and a switch unit operatively connected to the front plate for being operated when the front plate is moved sufficiently far from the normal position to cause a frangible area to be broken off the frangible element.

6 Claims, 8 Drawing Sheets

FIG. 11
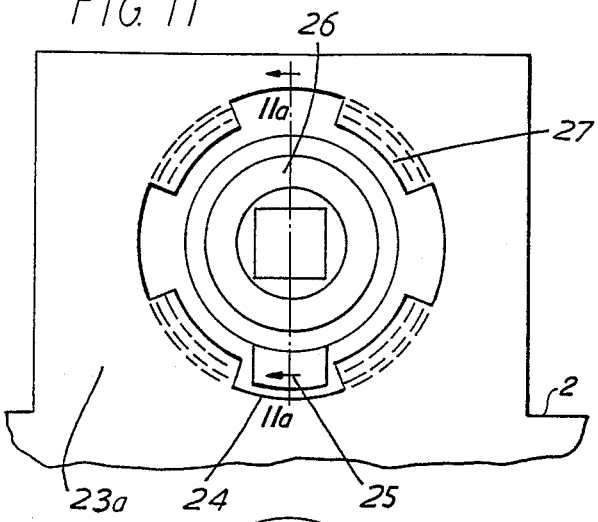
FIG. 11a
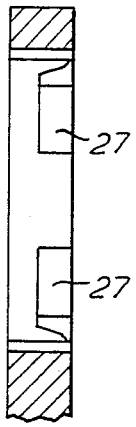
FIG. 11b
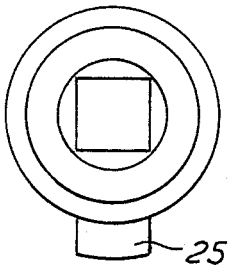
FIG. 11c
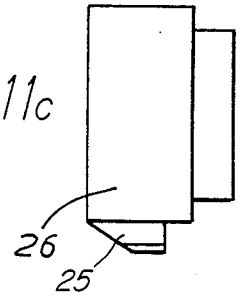
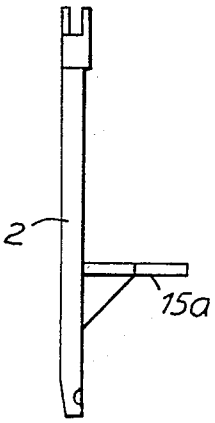
FIG. 13
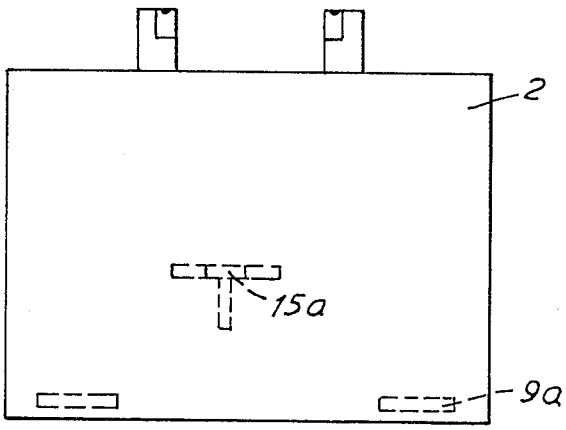
FIG. 12

ALARM SYSTEM

BACKGROUND OF THE INVENTION

The invention relates to an alarm switch which may typically be used as a fire alarm switch and which is of the kind known as a "manual call point". Such switches are mounted in a wall-mounted box with a front face which has a frangible element. Originally, the frangible element was a glass plate, but more satisfactory alternatives have been developed. The object of the invention is to provide an improved switch of this kind.

BRIEF SUMMARY OF THE INVENTION

According to the invention there is provided an alarm switch comprising a box for wall-mounting; a front plate for the box; a frangible element which may be broken by pushing the front plate; and a switch unit operated as a result of movement of the front plate because of the frangible element being broken, the frangible element comprising a plurality of frangible areas which may be broken from it and there being a stop element against which a frangible area bears so that the frangible area is broken off by pressure against the front plate, the frangible areas and the stop element being movable relative to each other so that the switch can be reset after use by arranging that the stop element co-operates with the next frangible area.

In this way resetting is facilitated. Preferably the resetting movement is rotary, the frangible areas being distributed around a circle. Alternatively, however, the resetting movement may be linear, with the frangible areas arranged in a line.

The frangible areas may be arranged on a body which is movable relative to a fixed stop. Alternatively the stop may be movable relative to fixed frangible areas. In one embodiment of the invention the frangible areas are fixed and form part of the front plate, The term "body" may thus mean the front plate.

For testing purposes it is desirable to be able to press the front plate in to the alarm position without breaking a frangible area. Accordingly, it is preferred to provide one or more by-pass regions between the frangible areas whereby the body may by-pass the stop. To reset the switch after testing it is necessary to draw the front plate back and move the stop and body relatively to each other to hold the plate in position against the stop by way of a frangible area. Preferably a special key and key-way arrangement is provided for moving the stop or body and for retrieving the plate.

BRIEF DESCRIPTION OF THE DRAWINGS

The invention will further be described with reference to the accompanying drawings, of which:

FIG. 11 is a plan view of an alternative form of frangible element and stop arrangement;

FIG. 11*a* is a section view thereof taken on line 11*a*—11*a* of FIG. 11;

FIG. 11*b* is a plan view of a rotatable arm forming part of the arrangement of FIG. 11;

FIG. 11*c* is a side elevation view of the arm of FIG. 11*a;*

FIG. 12 is a plan view of an alternative form of front plate;

FIG. 13 is a side elevation of the front plate of FIG. 12;

Referring to FIG. 1 the switch comprises a box 1 for wall-mounting with a base 1*a* and a lid 1*b*. A transparent front plate 2 of plastics material is situated immediately beneath the lid 1*b* and is exposed through a central aperture 3 in the lid. A frangible element 4 is situated near the top of the box 1 and has a frangible area 5 behind the front plate 2. The alarm is operated by pressing the front plate 2 and breaking off the area 5, whereupon a switch is operated in a manner to be described. Resetting can be effected by a reset key inserted in a square hole 6 in the element 4.

Referring to FIG. 2 the base 1*a* of the box has a micro-switch 8 mounted adjacent an upstanding wall 9 which acts as a pivot for the front plate 2, on which front plate 2 is supported near one end 2*a*. The other end 2*b* of the front plate 2 is supported by the frangible areas. This other end 2*b* can be regarded as a stop which co-operates with the frangible area 5 of the element 4. The micro-switch 8 is held in the off condition by the front plate 2 when front plate 2 is in the position shown in FIG. 2, but when the front plate 2 is pressed to break off the frangible area 5 it pivots clockwise in the figure to allow the switch contacts (not shown) of switch 8 to make and to operate the alarm.

FIG. 2 shows a mounting post 10 on which the element 4 is rotatably mounted. The post 10 has slots 11 by which is mounted a retraction arm 12 urged downwardly away from element 4 by a spring 13. The plate 2 has two dependent brackets 14, which embrace the arm 12. In a manner to be described, the arm 12 may be drawn back by a reset key to raise the front plate 2 and reset the switch.

FIGS. 3 and 3*a* show the front plate which has a tongue 15 which operates the micro-switch 8 and indents 9*a* which co-operate with detents 9*b* on the top of wall 9. The brackets 14 are shown also.

Referring now to FIGS. 4 to 6 the reset key has a square shank 16 with a reduced size cross-section mid-region 17 and an end portion 18.

FIGS. 7 and 8 show the frangible element 4 as having a body 19 and a square frangible plate 20, the four corners of which are the frangible areas 5. The element 4 may be turned by the reset key since the square shank 16 of the key fits the square hole 6 in the element 4. In this way, when one frangible area 5 at one corner has been broken off the plate 20 by operation of the switch, another frangible area 5 at another corner can be brought into position by turning the element 4 by 90°. The corners constituting the frangible areas 5 are visible through the front plate 2 to show when the switch is armed.

The dimensions of the element 4 are such that when turned through 45°, a side of the square plate 20 is brought into alignment with the edge of the front plate 2 and the front plate 2 is clear of the frangible plate 20. Thus, the front plate 2 can be moved to operate the switch for testing purposes.

Figure 9:
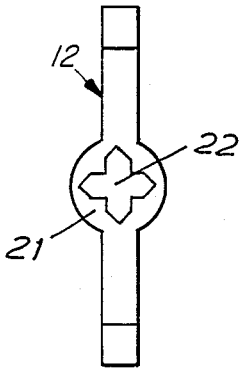
FIG. 9 is a plan view of the retractor arm of the switch.
Figure 10:
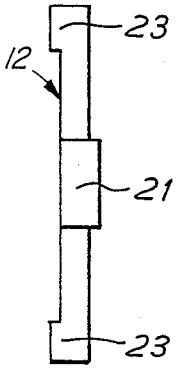
FIG. 10 is an end elevation view of the arm of FIG. 9.

The retraction arm 12 is shown in FIGS. 9 and 10 as having a central boss 21 with a star-shaped hole 22. Enlarged thickness areas 23 are provided at the ends of the arm 12 to co-operate with the brackets 14 of the front plate 2. The end portion 18 of the reset key may be inserted into the hole 22 when the key is aligned with or at right-angles to the arm 12 and thus when the element 4 is in the armed position. By turning the key through 45° after insertion into hole 22, the arm 12 can be engaged and retracted by retracting the key, thus drawing the front plate 2 back, since the plate 22 is now in the test position. Further turning of the key by 45° brings a frangible area 5 beneath the front plate 2 and holds the plate 2 in position. The key can then be withdrawn.

FIGS. 11–11*c* show an alternative arrangement, where the front plate itself is provided with the frangible areas. A projection 23*a* on the front plate 2 has a hole 24 into which project four frangible teeth 27. The front plate 2 is held in the armed position by co-operation of one of the teeth 27 with a stop 25 which is the end of a rotatable arm 26. It will be seen that here the roles of frangible element and stop are reversed with respect to the previously described arrangement. Here it is the stop 25 which is movable by rotation and not the frangible element 27. Otherwise the test and resetting arrangements are similar.

The frangible areas may be frangible by suitable choice of brittle material—for example plastics, or by local weakening as by reduced thickness or scoring.

Figure 1:
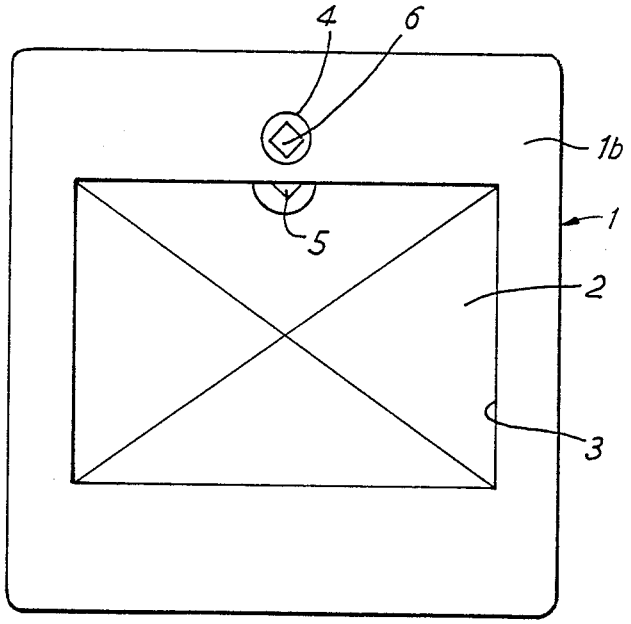
FIG. 1 is a plan view of an alarm switch in accordance with the invention.
Figure 2:
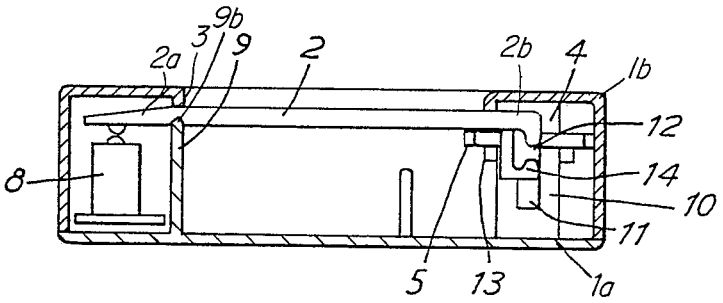
FIG. 2 is a side elevation of the switch of FIG. 1 with the lid removed.
Figure 3A:
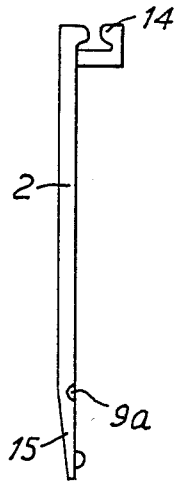
FIG. 3*a* is an end view of the front plate of FIG. 3.
Figure 3:
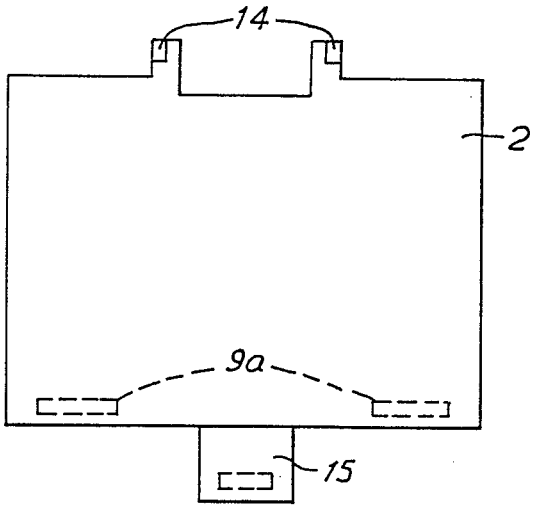
FIG. 3 is a plan view of the front plate of the switch.
Figure 4:
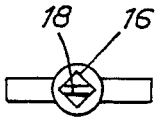
FIG. 4 is a side elevation of the reset key for the switch.
Figure 5:
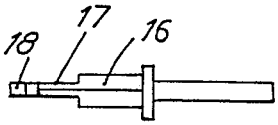
FIG. 5 is a side elevation of the reset key.
Figure 6:
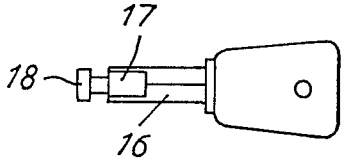
FIG. 6 is a plan view of the reset key.
Figure 7:
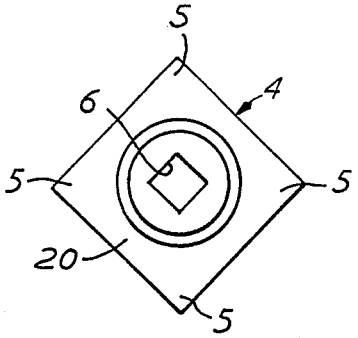
FIG. 7 is a plan view of the frangible element of the switch.
Figure 8:
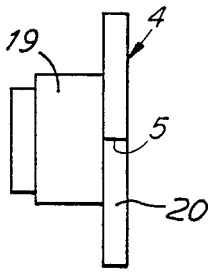
FIG. 8 is a side elevation of the frangible element.

Referring now to FIGS. 12 and 13, there is shown an alternative arrangement for the front plate 2. In this embodiment there is no tongue 15 but instead there is a dependent bracket 15*a*. The microswitch (not shown in FIGS. 12 and 13) is mounted centrally in the box in this embodiment and on its side rather than upright as in the arrangement of FIG. 3 and is operated by the bracket 15*a*.

There are no brackets 14, the plate 2 engaging the arm 12 directly in this embodiment. This arrangement allows the unit to be housed in a shallower box.

Figure 14:
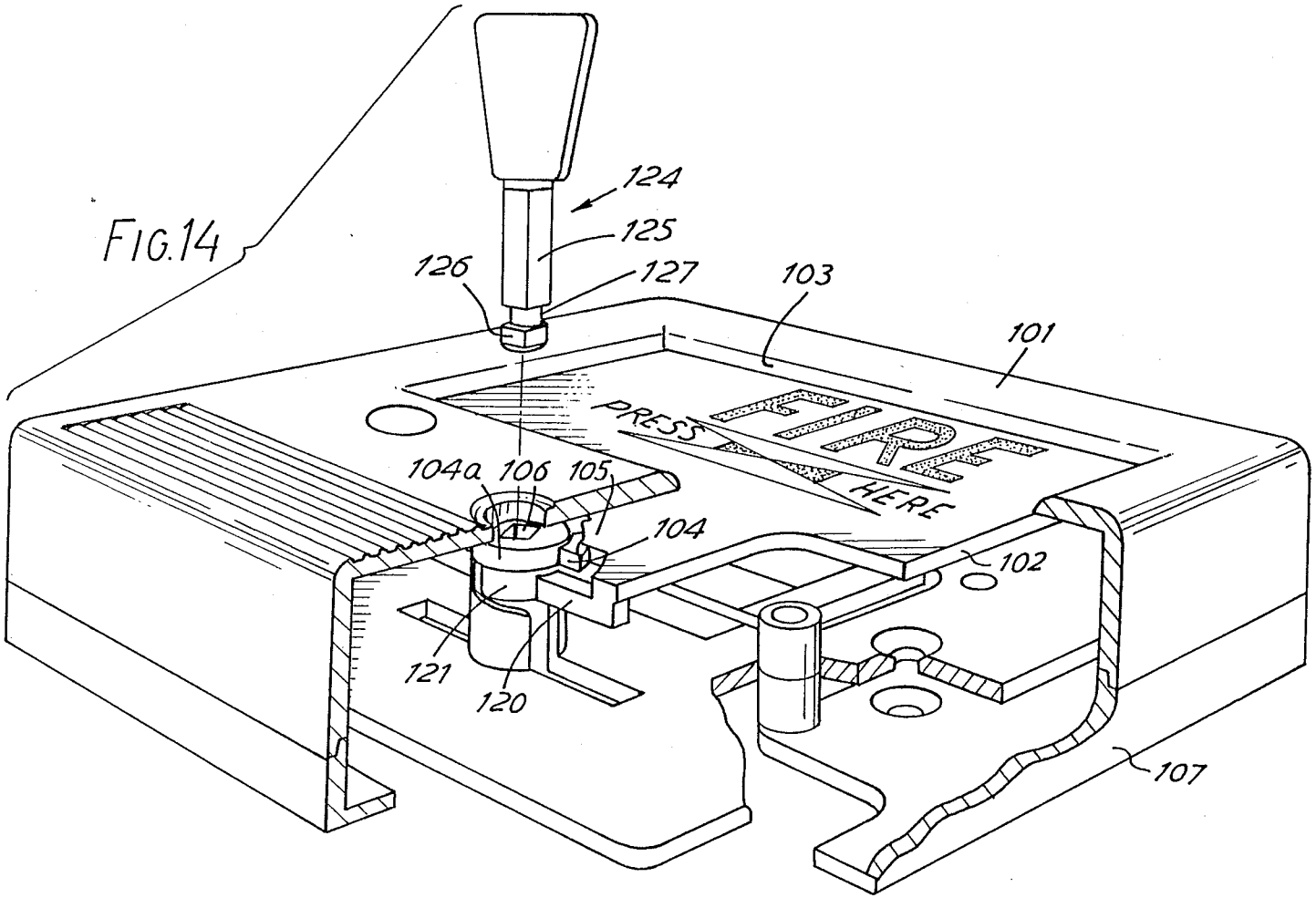
FIGS. 14 and 15 are perspective views partly broken away from respective view points of an alarm switch in accordance with another embodiment of the invention.
Figure 15:
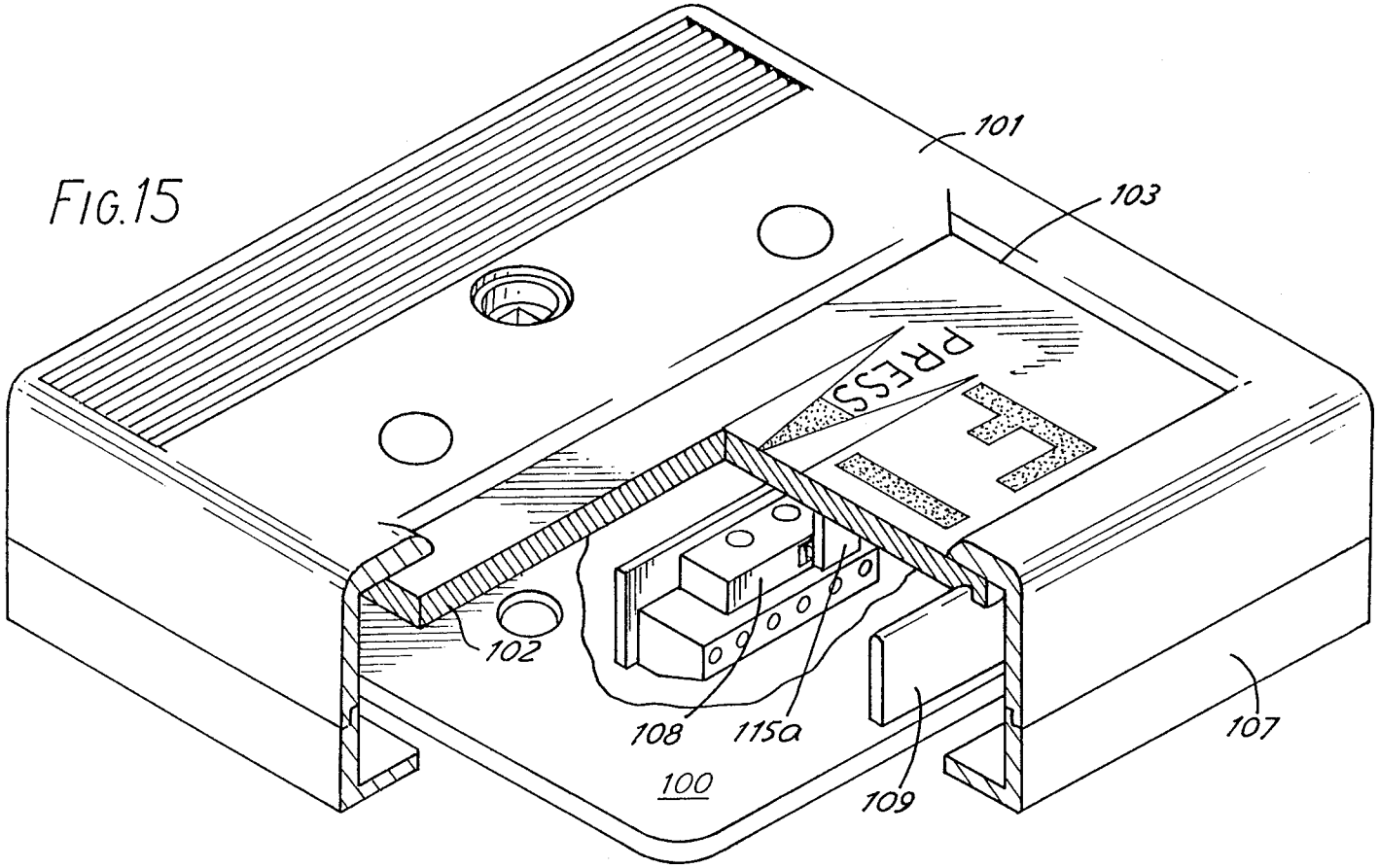

Referring to FIGS. 14 and 15 the switch comprises a box for wall-mounting with a base 107 and a lid 101. A front plate 102 of plastics material which is situated immediately beneath the lid is exposed through a central aperture 103 in the lid. A rotatable stop disc 104*a* with a stop lug 104 is situated beneath a set of frangible teeth 105 which form part of the front plate 102. The alarm is operated by pressing the front plate and breaking off a tooth 105 against the lug 104, whereupon a switch 108 is operated in a manner to be described. Resetting can be effected by a reset key 124 inserted in the square hole 106 in the element 104*a*.

The base of the box is shown at 107 and has the micro-switch 108 which co-operates with a bracket 115*a* on the front plate 102. The front plate 102 pivots on a wall 109 on which it is supported near one end. The other end of the front plate is supported by the frangible tooth 105. The micro-switch 108 is held in the off position by the bracket 115*a* on the front plate 102 when plate 4 is in the normal position, but when the front plate 2 is pressed to break off the frangible tooth 105 it pivots to allow the bracket 115*a* to release the switch to permit the contacts to make (or break) and operate the alarm.

Figure 16:
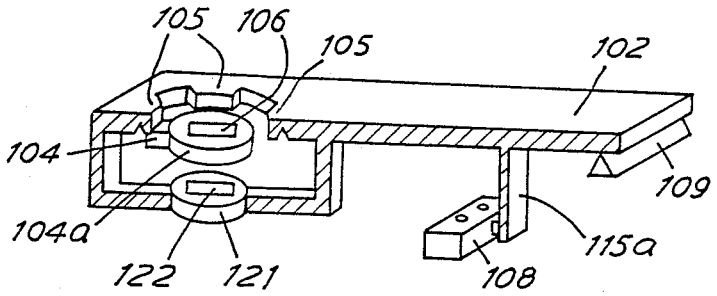
FIGS. 16 to 19 are schematic diagrams of stages of operation of the switch.

The front plate 102 has a retrieval member 120 which is moulded integrally in the form of a stirrup including a ring 121 with a square hole 122 noting FIG. 16. The stop disc 104 has a similar square hole 106. A reset key 124 is used to retrieve the front plate 102 and reset the alarm after operation or testing. The reset key 124 has a square shank 125 which engages the hole 106, a square end portion 126 which engages the hole 122 and a cylindrical midportion 127.

Referring to FIG. 16 there is shown a schematic view of the alarm in the armed condition. The front plate 102 rests at one end on the wall 109 and at the other end on stop lug 104 by way of a frangible tooth 105. The switch 108 is held in the off position by the bracket 115*a*.

Figure 17:
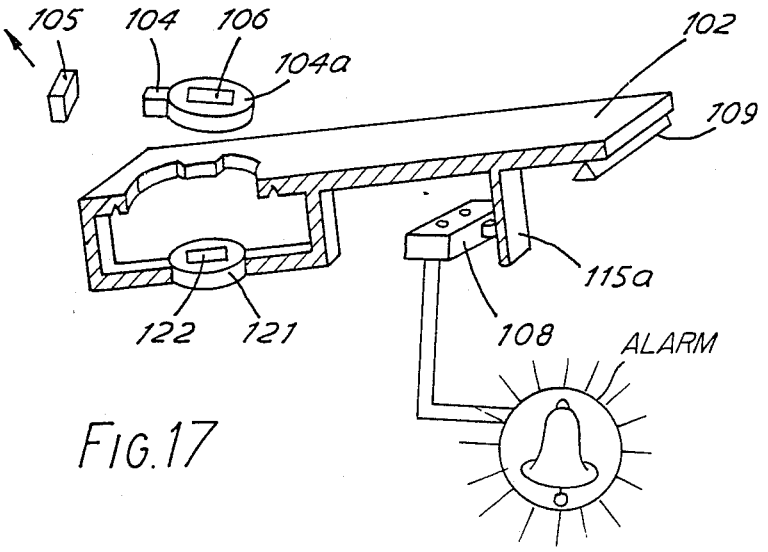

FIG. 17 shows the condition of the alarm with the front plate 102 having been pressed to operate the alarm. Tooth 105 is broken off against the stop lug 104, so allowing the front plate 102 to drop and the switch 108 to close (or open) to operate the alarm.

Figure 18:
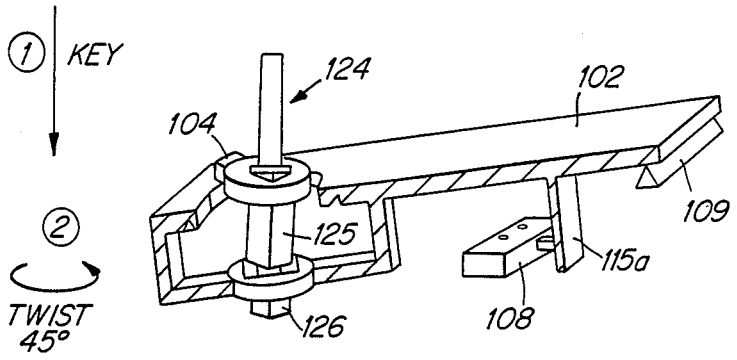
Figure 19:
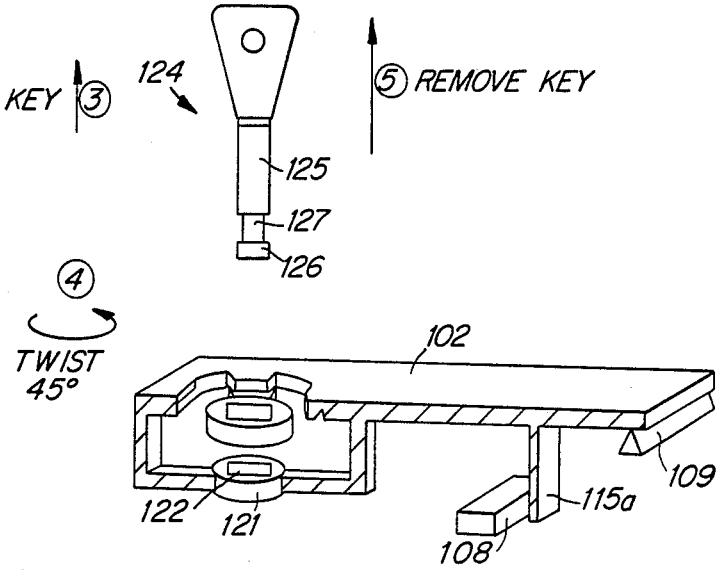

FIGS. 18 and 19 show the alarm being rearmed. Successive sequential steps are shown by the circled numbers 1–5, respectively. The reset key 124 is inserted through the stop disc 104*a* and the end portion 126 is inserted through hole 122. When the end portion 126 has passed completely through the hole 122 the key is twisted by 45°. This is allowed because of the cylindrical midportion 127. On being twisted through 45°, the end portion 126 of the key engages the ring 121 and allows the front plate 102 to be drawn back. The stop disc 104*a* has been rotated through 45° and the front plate 102 may be drawn past the lug 104, whereupon further twisting of the key by 45° turns the stop disc 104*a* to place the lug 104 beneath the next frangible tooth 105 and aligns the end portion 126 with hole 122 so that the key may be withdrawn, the alarm having then been reset, as shown in FIG. 19.

In order to test the alarm without breaking a tooth, the key 104 may be used to twist the stop disc 104*a* by 45°, thus allowing the front plate 102 to drop in and close (or open) switch 108. Resetting is accomplished as described above.

It will be seen that since there are four teeth 105, the alarm may be operated four times before a replacement front plate 102 is required.

We claim:

1. An alarm switch, comprising:

a box for mounting on a supporting surface;

a front plate movably mounted in said box;

a frangible element having a plurality of frangible areas spaced in succession thereon and each of which can be broken off said frangible element;

a stop element on one of said box and said front plate, and said frangible element being on the other of said box and said front plate, said stop element and said frangible element being positioned for, when said front plate is moved from a normal position relative to said box, said stop element and one of said frangible areas are engaged for causing the frangible area to be broken off said frangible element, and said frangible element and said stop element being shiftable relative to each other for, after one frangible area has been broken off, bringing the stop element and the next frangible area in succession into position for being engaged with each other when said front plate is moved again; and a switch unit operatively connected to said front plate for being operated when said front plate is moved sufficiently far from said normal position to cause a frangible area to be broken off said frangible element.

2. An alarm switch as claimed in claim 1 in which said frangible element is fixed and said stop element is shiftable relative to said frangible element.

3. An alarm switch as claimed in claim 2 in which said frangible element is part of said front plate.

4. An alarm switch as claimed in claim 1 in which said stop element is fixed and said frangible element is shiftable relative to said stop element.

5. An alarm switch as claimed in claim 1 in which said frangible areas are located along the circumference of a circle, and the shifting movement of said frangible element and said stop element relative to each other is a circular shifting movement.

6. An alarm switch as claimed in claim 1 further comprising a retrieval member on said front plate, said retrieval member and said frangible element each having a hole therein with a shaped cross-section, and a reset key having a shank with a cross-section the same in shape as the holes in said retrieval member and said frangible element and having an end portion having a shape for passing through the hole in said retrieval member and, upon the reset key being turned, engaging the retrieval member so as not to be withdrawable through the hole therein, and further having a reduced diameter portion between the shank and the end portion for permitting the reset key to be turned relative to said retrieval member when said reduced diameter portion is in the hole in said retrieval member, whereby the reset key can be inserted in said holes and turned to turn the frangible member and to engage said retrieval member to cause the retrieval member and the front plate to be pulled in the direction in which the reset key is pulled for retracting it from said holes.

* * * * *